US009269555B2

(12) United States Patent
Tate et al.

(10) Patent No.: US 9,269,555 B2
(45) Date of Patent: Feb. 23, 2016

(54) REMOVAL OF IONS FROM SURVEY SCANS USING VARIABLE WINDOW BAND-PASS FILTERING TO IMPROVE INTRASCAN DYNAMIC RANGE

(75) Inventors: Stephen A. Tate, North York, CA (US); Nic G. Bloomfield, Barrie, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/123,184

(22) PCT Filed: May 30, 2012

(86) PCT No.: PCT/IB2012/001054

§ 371 (c)(1),
(2), (4) Date: Nov. 29, 2013

(87) PCT Pub. No.: WO2012/164378

PCT Pub. Date: Dec. 6, 2012

(65) Prior Publication Data

US 2014/0117224 A1 May 1, 2014

Related U.S. Application Data

(60) Provisional application No. 61/493,364, filed on Jun. 3, 2011.

(51) Int. Cl.
*H01J 49/06* (2006.01)
*H01J 49/00* (2006.01)

(52) U.S. Cl.
CPC ..... *H01J 49/06* (2013.01); *H01J 49/004* (2013.01); *H01J 49/0031* (2013.01)

(58) Field of Classification Search
CPC ..... H01J 49/06; H01J 49/0031; H01J 49/004
USPC ..... 250/281, 282
See application file for complete search history.

(56) References Cited

U.S. PATENT DOCUMENTS 7,038,197 B2 * 5/2006 Bateman et al. ..... 250/281
7,589,318 B2 * 9/2009 Bloomfield et al. ..... 250/282

(Continued)

OTHER PUBLICATIONS

Kathleen E. Singleton et al: "Utilization of Natural Isotopic Abundance Ratios in Tandem Mass Spectrometry," Analytical Chemistry, vol. 55, No. 4, Apr. 1, 1983, pp. 762-764, XP55043881, ISSN: 0003-2700, DOI: 10/1021/ac00255a039.

(Continued)

*Primary Examiner* — Robert Kim
*Assistant Examiner* — Wyatt Stoffa
(74) *Attorney, Agent, or Firm* — John R. Kasha; Kelly L. Kasha; Kasha Law LLC

(57) ABSTRACT

Systems and methods are used to band-pass filter ions from a mass range. A full spectrum is received for a full scan of a mass range using a tandem mass spectrometer. A mass selection window of the full spectrum is selected and a set of tuning parameter values is selected. The tandem mass spectrometer is instructed to perform a scan of the mass selection window using the set of tuning parameter values. A spectrum is received for the scan from the tandem mass spectrometer. A band-pass filtered spectrum is created for the mass range that includes values from the spectrum for the mass selection window of the mass range. Systems and methods are also used to band-pass filter ions from two or more mass selection windows across the mass range and to filter out ions from a mass selection window between two band-pass mass selection windows.

18 Claims, 4 Drawing Sheets

(56) References Cited

U.S. PATENT DOCUMENTS

| | | | | |
|---|---|---|---|---|
| 2002/0024009 | A1* | 2/2002 | Baranov | 250/282 |
| 2003/0071206 | A1* | 4/2003 | Belov et al. | 250/282 |
| 2004/0084613 | A1* | 5/2004 | Bateman et al. | 250/281 |
| 2006/0006326 | A1* | 1/2006 | Belov et al. | 250/282 |
| 2007/0164207 | A1* | 7/2007 | Bloomfield et al. | 250/282 |
| 2011/0226943 | A1* | 9/2011 | Rather | 250/282 |
| 2013/0087701 | A1* | 4/2013 | Ivosev et al. | 250/282 |
| 2013/0119247 | A1* | 5/2013 | Green et al. | 250/282 |
| 2013/0181123 | A1* | 7/2013 | Rather | 250/282 |

OTHER PUBLICATIONS

J. Throck Watson, O. David Sparkman: "Introduction to Mass Spectrometry," 2007, John Wiley & Sons, Ltd, Chichester, West Sussex, England, ISBN: 978-0-470-51634-8, pp. 184-191.

* cited by examiner

REMOVAL OF IONS FROM SURVEY SCANS USING VARIABLE WINDOW BAND-PASS FILTERING TO IMPROVE INTRASCAN DYNAMIC RANGE

CROSS-REFERENCE TO RELATED APPLICATION

This application claims the benefit of U.S. Provisional Patent Application No. 61/493,364, filed Jun. 3, 2011, which is incorporated by reference herein in its entirety.

INTRODUCTION

The detector sub-system of a mass analyzer of a tandem mass spectrometer can experience saturation. For example, saturation can occur when a total ion count rate of the detection sub-system is exceeded. Saturation can also occur when the intensity of a single ion peak exceeds a threshold intensity of the detection sub-system.

Tandem mass spectrometers have employed various methods to remove saturation when it is detected. One method, for example, is to automatically attenuate the ion beam under programmatic control. When saturation is detected, the ion beam is attenuated between 1% and 100% in response to the level of saturation, for example.

Preventing or avoiding saturation using an automatic method can also produce unwanted effects. For example, background ions can be very intense at the same point in liquid chromatography (LC) time as an ion of interest. The automatic method sees an intense ion, but cannot distinguish an intense background ion from an ion of interest. As a result, it attenuates the ion beam to protect the background ion from saturating. Meanwhile, the attenuation of the ion beam causes the intensity of the ion of interest to be reduced to a point where it is no longer detectable.

BRIEF DESCRIPTION OF THE DRAWINGS

The skilled artisan will understand that the drawings, described below, are for illustration purposes only. The drawings are not intended to limit the scope of the present teachings in any way.

Figure 1:
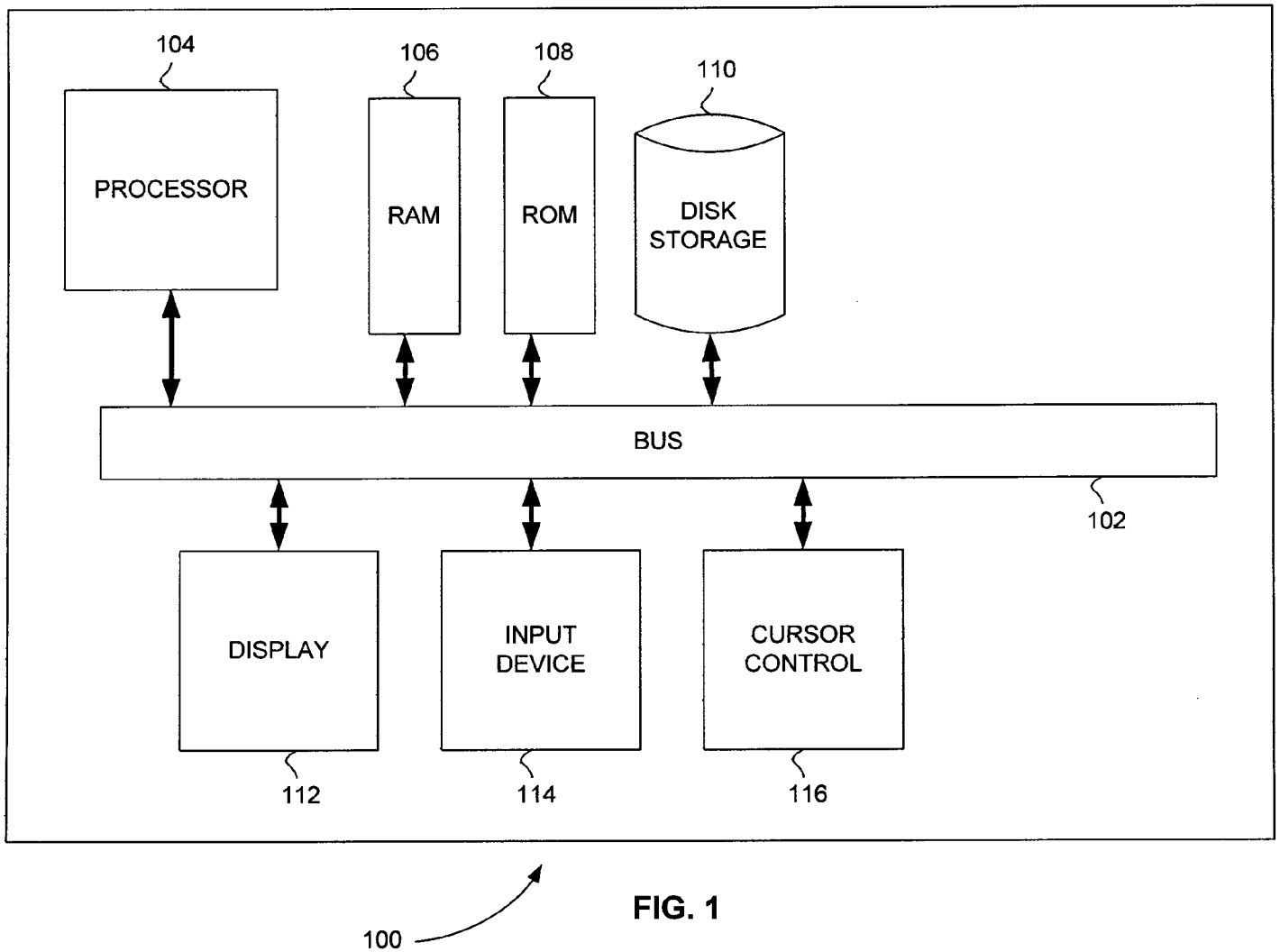
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods of Data Processing

As described above, automatic methods have been developed to prevent or avoid saturation caused by the detector sub-system of a mass analyzer of a tandem mass spectrometer. Such automatic methods, however, can produce additional unwanted effects because they generally affect all ions equally. For example, an automatic method that attenuates the ion beam to remove the saturation of an intense background ion can result in the loss of the intensity from an ion of interest.

In various embodiments, ions that can produce saturation are selectively removed or filtered in order to prevent ions of interest from being affected by a global automatic saturation detection and removal method. Essentially a prescan or a scan from a previous survey scan is used to identify ions for removal. One or more subsequent survey or scans are then used to remove the identified ions. In addition to removing ions that can produce saturation, this technique can also be used to remove ions previously analyzed or fragmented.

In a tandem mass spectrometer, a precursor ion is selected in a first mass analyzer and fragmented, and the fragments are analyzed in a second analyzer or in a second scan of the first analyzer. The fragment ion spectrum can be used to identify the molecule and the intensity of one or more fragments can be used to quantitate the amount of the compound present in a sample.

Typically, scans occur at uniform mass selection windows across a mass range. Recent developments in mass spectrometry hardware have, however, allowed the mass selection window width of a tandem mass spectrometer to be varied or set to any value instead of a single value across a mass range. For example, independent control of both the radio frequency (RF) and direct current (DC) voltages applied to a quadrupole mass filter can allow the selection of variable mass selection window widths. Any type of tandem mass spectrometer can allow the selection of variable mass selection window widths. A tandem mass spectrometer can include one or more physical mass analyzers that perform two or more mass analyses. A mass analyzer of a tandem mass spectrometer can include, but is not limited to, a time-of-flight (TOF), quadrupole, an ion trap, a linear ion trap, an orbitrap, or a Fourier transform mass spectrometer.

In various embodiments, scans with variable mass selection window widths are used to filter ions from regions of a mass range. A prescan of the full mass range is taken or a previous survey scan is used to produce a full spectrum for the mass range. Non-overlapping mass selection windows with variable mass selection window widths are then selected from the mass range. These mass selection windows are selected to either allow ions to be scanned and added to a band-pass spectrum or to prevent ions from being scanned and included in the band-pass spectrum.

Mass selection windows that are selected to allow ions to be scanned and added to the band-pass spectrum can include quiet regions of the full spectrum, for example. In addition to selecting the mass selection window for these quiet regions, other tuning parameter values for the mass spectrometer can also be selected. Tuning parameters for a mass spectrometer can include, but are not limited to, maximum intensity or total ion current. Different tuning parameter values can be selected for the scans of different mass selection windows.

Mass selection windows that are selected to prevent ions from being scanned and included in the band-pass spectrum can include saturated regions of the full spectrum or regions that include ions that have previously been fragmented, for example. The intensity values for ions in these mass selection windows are prevented from being included in the band-pass spectrum by not performing a scan for these mass selection windows. Because a scan is not performed, the band-pass spectrum includes zero intensity values for these mass selection windows.

Ion Filter System

Figure 2:
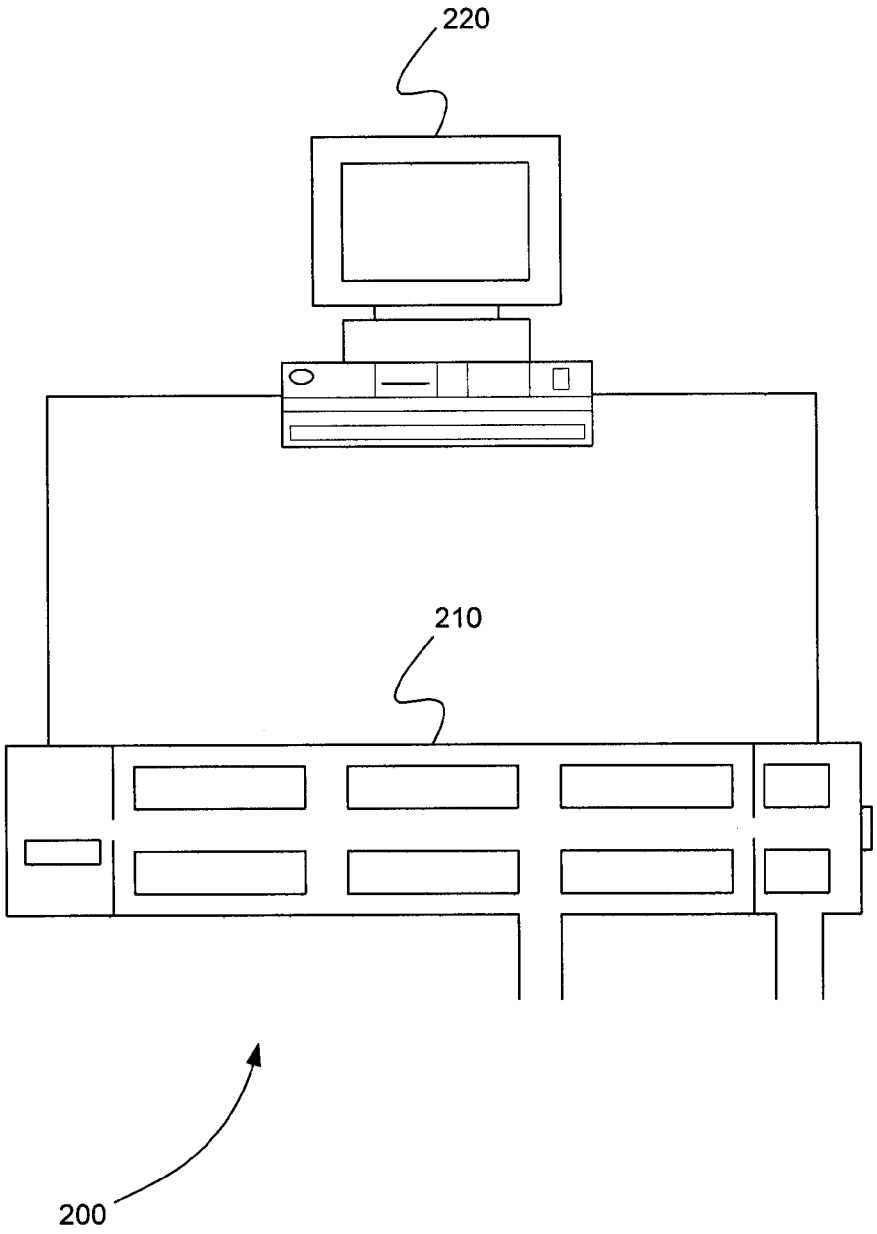
FIG. 2 is a schematic diagram showing a system for band-pass filtering ions from a mass range, in accordance with various embodiments.

FIG. 2 is a schematic diagram showing a system 200 for band-pass filtering ions from a mass range, in accordance with various embodiments. System 200 includes tandem mass spectrometer 210 and processor 220. Processor 220 can be, but is not limited to, a computer, microprocessor, or any device capable of sending and receiving control signals and data from mass spectrometer 210 and processing data.

Tandem mass spectrometer 210 can include one or more physical mass analyzers that perform two or more mass analyses. A mass analyzer of a tandem mass spectrometer can include, but is not limited to, a time-of-flight (TOF), quadrupole, an ion trap, a linear ion trap, an orbitrap, or a Fourier transform mass analyzer. Tandem mass spectrometer 210 can also include a separation device (not shown). The separation device can perform a separation technique that includes, but is not limited to, liquid chromatography, gas chromatography, capillary electrophoresis, or ion mobility. Tandem mass spectrometer 210 can include separating mass spectrometry stages or steps in space or time, respectively.

Tandem mass spectrometer 210 includes a mass analyzer and can perform scans at different mass selection window widths using different tuning parameter values. Tandem mass spectrometer 210 performs a full scan of a mass range. The mass range can include, for example, a preferred mass range of the sample or the entire mass range of the sample. The full scan can include, but is not limited to, a prescan or a previous survey scan.

Processor 220 is in communication with tandem mass spectrometer 210. Processor 220 receives a full spectrum for the full scan from tandem mass spectrometer 210. Processor 220 selects a first mass selection window of the full spectrum and selects a first set of tuning parameter values. Processor 220 instructs tandem mass spectrometer 210 to perform a first scan of the first mass selection window using the first set of tuning parameter values. Processor 220 receives a first spectrum for the first scan from tandem mass spectrometer 210. Finally, processor 220 creates a band-pass filtered spectrum for the mass range that includes values from the first spectrum for the first mass selection window of the mass range.

In various embodiments, system 200 can be used to band-pass filter ions from two or more mass selection windows across the mass range. For example, processor 220 further selects one or more additional mass selection windows of the full spectrum and selects one or more additional sets of tuning parameter values. The first mass selection window and the one or more additional mass selection windows do not overlap in the full spectrum. Processor 220 instructs the tandem mass spectrometer to perform one or more scans of the one or more additional mass selection windows using the one or more additional sets of tuning parameter values. Processor 220 receives one or more spectra for the one or more scans from the tandem mass spectrometer. Processor 220 adds to the band-pass filtered spectrum values from the one or more spectra for the one or more additional mass selection windows of the mass range.

In various embodiments, system 200 can be used to filter out ions from a mass selection window between two band-pass mass selection windows. For example, processor 220 further selects a second mass selection window of the full spectrum and selects a second set of tuning parameter values. The first mass selection window and the second mass selection window do not overlap in the full spectrum. Processor 220 instructs tandem mass spectrometer 210 to perform a second scan of the second mass selection window using the second set of tuning parameter values. Processor 220 receives a second spectrum for the second scan from tandem mass spectrometer 210. Finally, processor 220 adds to the band-pass filtered spectrum values from the second spectrum for the second mass selection window of the mass range.

In various embodiments, scans for two or more mass selection windows across the mass range can include different tuning parameter values. For example, the first set of tuning parameter values and the second set of tuning parameter values described above do not share at least one value.

Processor 220 further selects a third mass selection window of the full spectrum between the first mass selection window and the second mass selection window. The third mass selection window can include a high intensity ion, a high ion count rate, or an ion from a list of previously fragmented ions, for example. Processor 220 adds to the band-pass filtered spectrum zero values for the third mass selection window of the mass range. The first mass selection window, the second mass selection window, and the third mass selection window do not have the same widths, for example.

Ion Filter Method

Figure 3:
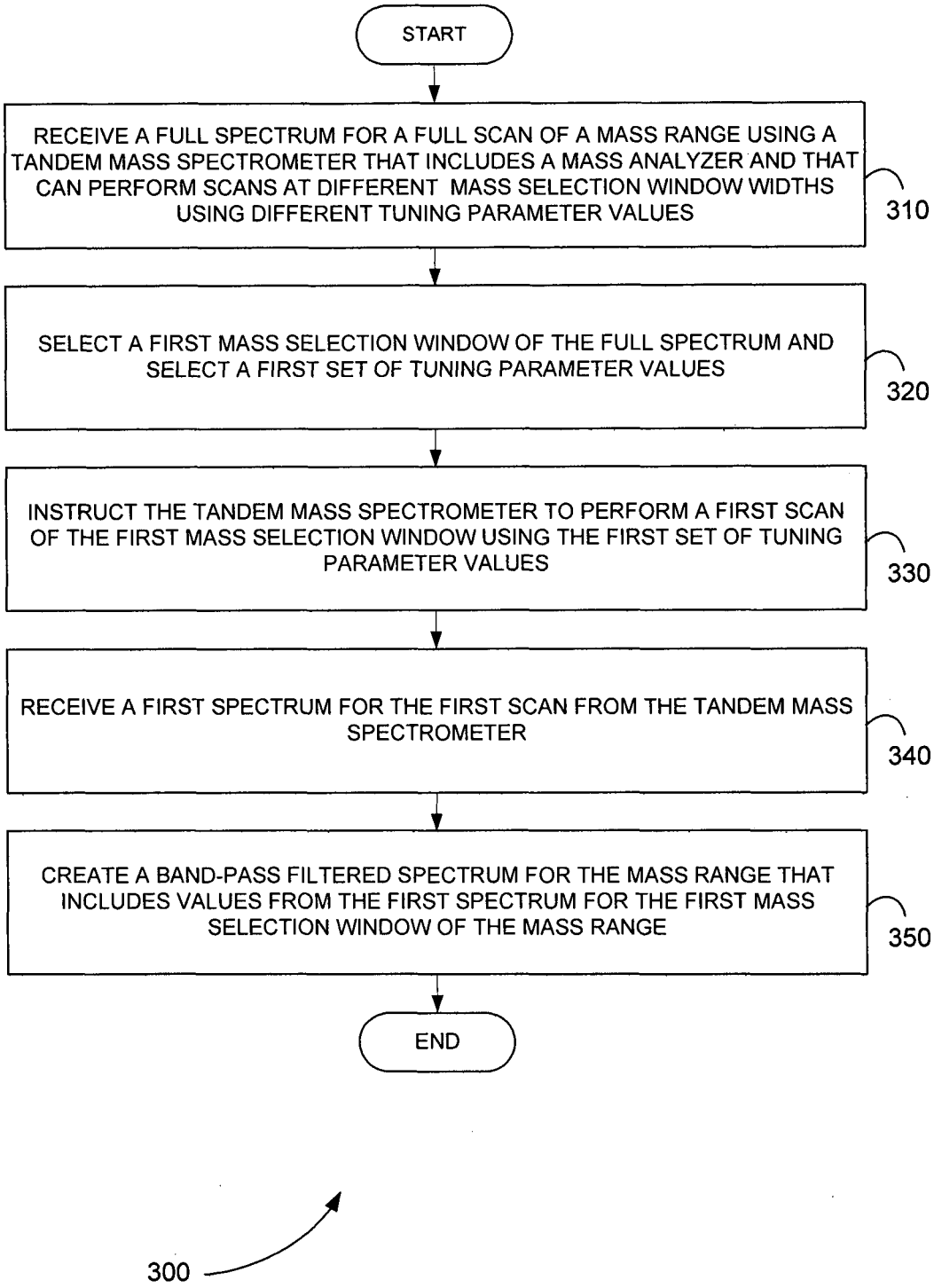
FIG. 3 is an exemplary flowchart showing a method for band-pass filtering ions from a mass range, in accordance with various embodiments.

FIG. 3 is an exemplary flowchart showing a method 300 for band-pass filtering ions from a mass range, in accordance with various embodiments.

In step 310 of method 300, a full spectrum is received for a full scan of a mass range using a tandem mass spectrometer. The tandem mass spectrometer includes a mass analyzer and can perform scans at different mass selection window widths using different tuning parameter values.

In step 320, a first mass selection window of the full spectrum is selected and a first set of tuning parameter values is selected.

In step 330, the tandem mass spectrometer is instructed to perform a first scan of the first mass selection window using the first set of tuning parameter values.

In step 340, a first spectrum is received for the first scan from the tandem mass spectrometer.

In step 350, a band-pass filtered spectrum is created for the mass range that includes values from the first spectrum for the first mass selection window of the mass range.

Ion Filter Computer Program Product

In various embodiments, a computer program product includes a tangible computer-readable storage medium whose contents include a program with instructions being executed on a processor so as to perform a method for band-pass filtering ions from a mass range. This method is performed by a system that includes one or more distinct software modules.

Figure 4:
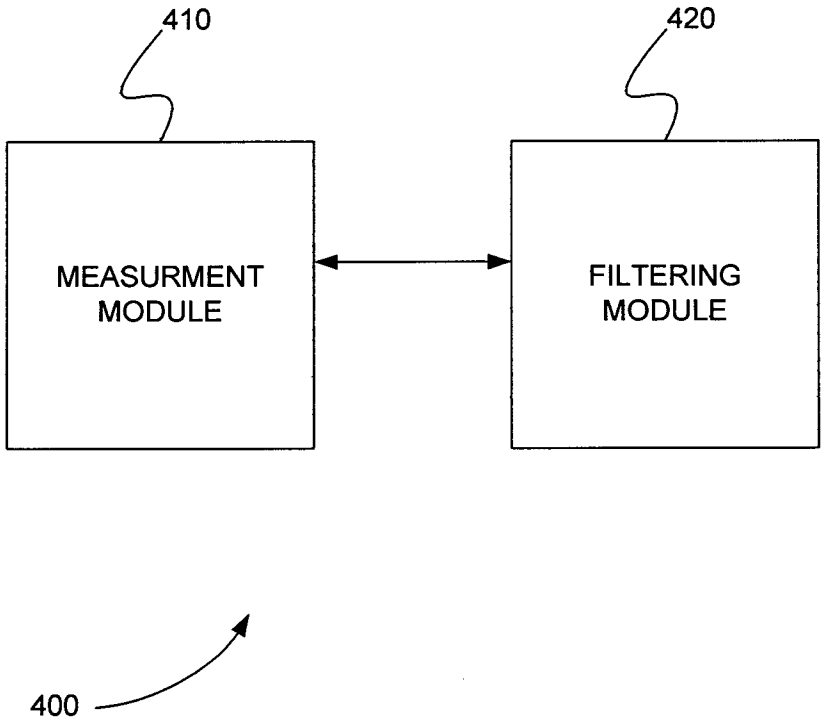
FIG. 4 is a schematic diagram of a system that includes one or more distinct software modules that performs a method for band-pass filtering ions from a mass range, in accordance with various embodiments.

FIG. 4 is a schematic diagram of a system 400 that includes one or more distinct software modules that performs a method for band-pass filtering ions from a mass range, in accordance with various embodiments. System 400 includes measurement module 410 and filtering module 420.

Measurement module 410 receives a full spectrum for a full scan of a mass range using a tandem mass spectrometer. The tandem mass spectrometer includes a mass analyzer and can perform scans at different mass selection window widths using different tuning parameter values. Filtering module 420 selects a first mass selection window of the full spectrum and selects a first set of tuning parameter values. Measurement module 410 instructs the tandem mass spectrometer to perform a first scan of the first mass selection window using the first set of tuning parameter values. Measurement module 410 receives a first spectrum for the first scan from the tandem mass spectrometer. Filtering module 420 creates a band-pass filtered spectrum for the mass range that includes values from the first spectrum for the first mass selection window of the mass range.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for band-pass filtering ions from a mass range, comprising:

a tandem mass spectrometer that includes a mass analyzer that can analyze precursor ions or fragment ions using different sets of tuning parameter values; and a processor in communication with the tandem mass spectrometer that instructs the tandem mass spectrometer to perform a precursor ion survey scan of a mass range, producing a full precursor ion spectrum for the mass range, receives the full precursor ion spectrum from the tandem mass spectrometer, from the full precursor ion spectrum, identifies for removal precursor ions that produce saturation in a detector sub-system of the mass analyzer, across the mass range, selects non-overlapping precursor mass selection windows with variable window widths based on the precursor ions identified for removal, wherein each precursor mass selection window is selected either to include a precursor ion identified for removal and to prevent precursor ions from being fragmented or is selected to not include a precursor ion identified for removal and to allow precursor ions to be fragmented and allow resulting fragmented ions to be mass analyzed, instructs the tandem mass spectrometer to fragment and analyze fragment ions of only precursor mass selection windows that are selected to not include a precursor ion identified for removal using a set of tuning parameter values for the detection sub-system, producing a plurality of fragment ion spectra, and receives the plurality of fragment ion spectra from the tandem mass spectrometer and creates a band-pass filtered fragment ion spectrum from the plurality of fragment ion spectra.

2. The system of claim 1, wherein the processor identifies for removal precursor ions that produce saturation in the detector sub-system by identifying precursor ions in the full precursor ion spectrum that have an ion count rate that exceeds a total ion count rate of the detector sub-system.

3. The system of claim 1, wherein the processor identifies for removal precursor ions that produce saturation in the detector sub-system by identifying precursor ions in the full precursor ion spectrum that have an intensity that exceeds a threshold intensity of the detector sub-system.

4. The system of claim 1, wherein the set of tuning parameter values comprise a maximum intensity value of the detection sub-system.

5. The system of claim 1, wherein the set of tuning parameter values comprise a total ion current value of the detection sub-system.

6. The system of claim 1, wherein the processor further instructs the tandem mass spectrometer to fragment the precursor mass selection windows that are selected to not include a precursor ion identified for removal using one or more different sets of tuning parameter values for the detection sub-system.

7. A method for band-pass filtering ions from a mass range, comprising:

receiving a full precursor ion spectrum from a tandem mass spectrometer that includes a mass analyzer that can analyze precursor ions or fragment ions using different sets of tuning parameter values, wherein the tandem mass spectrometer performs a precursor ion survey scan of a mass range to produce the full precursor ion spectrum for the mass range;

from the full precursor ion spectrum, identifying for removal precursor ions that produce saturation in a detector sub-system of the mass analyzer using a processor; and across the mass range, selecting non-overlapping precursor mass selection windows with variable window widths based on the precursor ions identified for removal using the processor, wherein each precursor mass selection window is selected either to include a precursor ion identified for removal and to prevent precursor ions from being fragmented or is selected to not include a precursor ion identified for removal and to allow precursor ions to be fragmented and allow resulting fragmented ions to be mass analyzed;

instructing the tandem mass spectrometer to fragment and analyze fragment ions of only precursor mass selection windows that are selected to not include a precursor ion identified for removal using a set of tuning parameter values for the detection sub-system, producing a plurality of fragment ion spectra; and receiving the plurality of fragment ion spectra from the tandem mass spectrometer and creating a band-pass filtered fragment ion spectrum from the plurality of fragment ion spectra using the processor.

8. The method of claim 7, wherein the identifying steps comprises identifying precursor ions in the full precursor ion spectrum that have an ion count rate that exceeds a total ion count rate of the detector sub-system.

9. The method of claim 7, wherein the identifying steps comprises identifying precursor ions in the full precursor ion spectrum that have an intensity that exceeds a threshold intensity of the detector sub-system.

10. The method of claim 7, wherein the set of tuning parameter values comprise a maximum intensity value of the detection sub-system.

11. The method of claim 7, wherein the set of tuning parameter values comprise a total ion current value of the detection sub-system.

12. The method of claim 7, further comprising:

instructing the tandem mass spectrometer to fragment the precursor mass selection windows that are selected to not include a precursor ion identified for removal using one or more different sets of tuning parameter values for the detection sub-system using the processor.

13. A computer program product, comprising a tangible computer-readable storage medium whose contents include a program with instructions being executed on a processor so as to perform a method for band-pass filtering ions from a mass range, the method comprising:

providing a system, wherein the system comprises one or more distinct software modules, and wherein the distinct software modules comprise a measurement module and a filtering module;

receiving a full precursor ion spectrum from a tandem mass spectrometer that includes a mass analyzer that can analyze precursor ions or fragment ions using different sets of tuning parameter values using the measurement module, wherein the tandem mass spectrometer performs a precursor ion survey scan of a mass range to produce the full precursor ion spectrum for the mass range;

from the full precursor ion spectrum, identifying for removal precursor ions that produce saturation in a detector sub-system of the mass analyzer using the filtering module;

across the mass range, selecting non-overlapping precursor mass selection windows with variable window widths based on the precursor ions identified for removal using the filtering module, wherein each precursor mass selection window is selected either to include a precursor ion identified for removal and to prevent precursor ions from being fragmented or is selected to not include a precursor ion identified for removal and to allow precursor ions to be fragmented and allow resulting fragmented ions to be mass analyzed;

instructing the tandem mass spectrometer to fragment and analyze fragment ions of only precursor mass selection windows that are selected to not include a precursor ion identified for removal using a set of tuning parameter values for the detection sub-system using the filtering module, producing a plurality of fragment ion spectra; and receiving the plurality of fragment ion spectra from the tandem mass spectrometer and creating a band-pass filtered fragment ion spectrum from the plurality of fragment ion spectra using the filtering module.

14. The computer program product of claim 13, wherein the identifying step comprises identifying precursor ions in the full precursor ion spectrum that have an ion count rate that exceeds a total ion count rate of the detector sub-system.

15. The computer program product of claim 13, wherein the identifying steps comprises identifying precursor ions in the full precursor ion spectrum that have an intensity that exceeds a threshold intensity of the detector sub-system.

16. The computer program product of claim 13, wherein the set of tuning parameter values comprise a maximum intensity value of the detection sub-system.

17. The computer program product of claim 13, wherein the set of tuning parameter values comprise a total ion current value of the detection sub-system.

18. The computer program product of claim 13, wherein the method further comprises:

instructing the tandem mass spectrometer to fragment the precursor mass selection windows that are selected to not include a precursor ion identified for removal using one or more different sets of tuning parameter values for the detection sub-system using the filtering module.

* * * * *